US011510446B2

(12) United States Patent
Torano et al.

(10) Patent No.: US 11,510,446 B2
(45) Date of Patent: Nov. 29, 2022

(54) DOUBLE-LAYERED FLAME RESISTANT GARMENT

(71) Applicant: Saudi Arabian Oil Company, Dhahran (SA)

(72) Inventors: Aniela Zarzar Torano, Dhahran (SA); Eric T. Anderson, Edmond, OK (US); Fatimah M. Barnawi, Dhahran (SA); Mohammed S. AbaHareth, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 48 days.

(21) Appl. No.: 16/919,317

(22) Filed: Jul. 2, 2020

(65) Prior Publication Data

US 2022/0000201 A1 Jan. 6, 2022

(51) Int. Cl.

| | |
|---|---|
| ***A41D 31/08*** | (2019.01) |
| ***A41D 13/05*** | (2006.01) |
| ***A62B 17/00*** | (2006.01) |

(52) U.S. Cl.

CPC ..... *A41D 31/085* (2019.02); *A41D 13/0525* (2013.01); *A62B 17/003* (2013.01)

(58) Field of Classification Search

CPC .. A41D 13/0525; A41D 31/08; A41D 31/085; A41D 2400/422; A41D 27/02; A41D 27/04; A41D 1/21; A41D 1/18; A41D 27/22; A41B 1/00; A41B 1/02; A41B 1/04; A41B 1/06; A41C 1/10; A62B 17/003

USPC ..... 2/458

See application file for complete search history.

(56) References Cited

U.S. PATENT DOCUMENTS 1,786,105 A * 12/1930 Clark ..... A41B 1/00 2/106
2,061,181 A * 11/1936 Yacovino ..... A41B 1/06 2/128
2,292,347 A * 8/1942 Bailey ..... A41D 15/00 2/93
4,601,069 A * 7/1986 Fiore, Jr. ..... A41D 1/18 2/106

(Continued)

FOREIGN PATENT DOCUMENTS

CN 101243220 A 8/2008

OTHER PUBLICATIONS

International Search Report & Written Opinion, Counterpart PCT Application No. PCT/US2021/038581; dated Oct. 14, 2021, 11 pages.

*Primary Examiner* — F Griffin Hall
(74) *Attorney, Agent, or Firm* — Leason Ellis LLP

(57) ABSTRACT

A flame resistant shirt includes an outer layer that has a main body portion and a pair of sleeves. The main body portion terminates in a bottom edge. The flame resistant shirt also includes an inner curtain that is coupled to an inner surface of the main body portion and has a top edge and an opposing bottom edge. The top edge of the inner curtain is located at a waist region of the main body portion and the inner curtain extends downwardly therefrom and the bottom edge of the inner curtain is disposed above the bottom edge of the main body portion. The inner curtain is intended to be tucked into a bottom garment, while the outer layer is intended to be worn untucked.

17 Claims, 5 Drawing Sheets

(56) References Cited

U.S. PATENT DOCUMENTS 4,709,421 A * 12/1987 Grilliot ..... A62B 17/003 2/81
4,768,233 A 9/1988 Grilliot et al.
4,774,725 A * 10/1988 Page ..... A41D 13/01 2/81
4,817,210 A * 4/1989 Aldridge ..... A62B 17/003 2/87
5,038,410 A * 8/1991 Grilliot ..... A41D 27/04 2/81
5,054,125 A * 10/1991 Snedeker ..... A62B 17/003 2/81
6,389,600 B1 * 5/2002 Di Maio ..... A41D 13/0015 2/121
7,340,780 B2 * 3/2008 Levy ..... A41D 1/04 2/107
7,426,755 B2 * 9/2008 Grilliot ..... A62B 17/003 2/81
7,578,005 B2 * 8/2009 Vereen ..... A41B 1/00 2/92
7,874,019 B2 * 1/2011 Woolcott ..... A41D 13/02 2/87
2005/0022285 A1 * 2/2005 Berns ..... A41D 1/082 2/69
2005/0044605 A1 * 3/2005 Hofmann ..... A62B 17/006 2/69
2005/0166300 A1 * 8/2005 Tanaka ..... A41D 1/04 2/108
2008/0134409 A1 6/2008 Karasina
2008/0178365 A1 7/2008 Furgerson et al.
2009/0298370 A1 12/2009 Rock
2011/0271419 A1 * 11/2011 Vereen ..... A41D 31/265 2/69
2013/0139298 A1 * 6/2013 Crump ..... A41D 27/20 2/247
2013/0227758 A1 9/2013 Doney
2016/0366961 A1 * 12/2016 Carie ..... A41B 1/08
2018/0295912 A1 * 10/2018 Watts ..... A41D 13/0058

* cited by examiner

DOUBLE-LAYERED FLAME RESISTANT GARMENT

TECHNICAL FIELD

The present invention is directed to the field of garments and more particularly, to a flame resistant shirt (blouse) that provides women with a modest alternative shirt construction, suitable to the Middle Eastern region, that still offers the highest level of protection in accordance with all relevant safety standards and regulations.

BACKGROUND

Workers in many industries can be subjected to sudden thermal flashes that directly impinge workers' bodies. During the course of an electrical are flash incident, for example, electrical workers can experience the intense effects of an electric are incident's tremendous thermal energy. Similarly, workers in active hydrocarbon facilities may experience the effects of flash fire of such intensity that a flash fire event can result in severe injury or even death. Accordingly, while most responsible operating companies adhere to design and operating standards aimed at assuring asset integrity and operational discipline to prevent such incidents, most employers will pro-actively supplement these by providing personal protective equipment (PPE). PPE is often required to be worn to protect workers from such sources of thermal energy. Flame resistant garments are specifically designed to protect against flames and thermal exposure. With respect to flame resistant shirts, they must not be worn untucked, as flames and heat may rise up from under the untucked garment directly exposing the wearer's skin to increased risk of burn injuries.

Female workers in some companies operating within the Middle Eastern region (and other regions) often wear flame resistant jackets over their flame resistant shirt and pants. However, as temperatures can rise up to 50° C. during the summer, this can potentially lead to heat stress due to the bulky nature of the layered clothing, the sheer weight of the clothing and the limited effectiveness of evaporative cooling through human biological mechanisms such as that associated with normal perspiration functions.

There is therefore a need to provide women with a modest alternative shirt construction, suitable to the Middle Eastern region, that still offers the highest level of protection in accordance with all relevant safety standards and regulations. The present garment (shirt) achieves all of these objectives.

SUMMARY

A flame resistant shirt is disclosed and includes an outer layer that has a main body portion and a pair of sleeves. The main body portion terminates in a bottom edge. The flame resistant shirt also includes an inner curtain that is coupled to an inner surface of the main body portion and has a top edge and an opposing bottom edge. The top edge of the inner curtain is located at a waist region of the main body portion and the inner curtain extends downwardly therefrom and the bottom edge of the inner curtain is disposed above the bottom edge of the main body portion. The inner curtain is intended to be tucked into a bottom garment (e.g., pants or trousers), while the outer layer is intended to be worn tucked or untucked over such bottom garment. Even though the shirt contains two layers, the inner curtain is only present from the waist down and moreover, both layers are preferably relatively light (4.5 oz/yd$^2$). While the shirt may be worn with the outer layer either tucked in or untucked (the inner curtain is always tucked in), one of the primary objectives for the present shirt construction is to provide protection that would otherwise not be available for conventional shirts in an untucked manner. This therefore provides additional variable use and protection factors currently not available with conventional designs. This helps overcome certain barriers to achieve greater diversity and gender inclusion in the workforce. Since the inner curtain can be tucked into the bottom garment, the shirt offers the highest level of protection in accordance with all relevant safety standards and regulations, while at the same time, the outer layer can be worn in an untucked manner thereby providing modesty since the bottom portion of the outer layer lies below the waist of the wearer and can be worn over pants/trousers.

The disclosed shirt thus allows the wearer to comply with both cultural norms and safety requirements. Through the present design, the wearer is able to avoid accentuating their form without the need of an extra garment; avoiding the additional garment layer helps prevent heat stress. Moreover, the wearer will be protected from potential intermittent flames or thermal exposure through the tucked-in inner curtain. The present garment thus has the ability to protect the life of the wearer in the event of a flash fire scenario. Commercially available alternatives currently do not accommodate certain conservative and modest configurations sought and preferred by individuals from various regions to respect and align with cultural norms.

The flame resistant shirt further includes a compliance indicator that is coupled to the inner curtain and extends downwardly therefrom and has a length such that when the inner curtain is in an untucked condition, a bottom end of the compliance indicator is visible below the bottom edge of the outer layer. Accordingly, if the wearer chose not to tuck the inner curtain in, the tag is easily visible to others (e.g., their supervisor) and/or to the wearer herself since the tag would protrude below the bottom edge of the outer layer. Conversely, when the inner curtain is properly tucked in, the tag will not be visible to the observer or the wearer. Thus, the tag is a feature that helps ensure compliance with proper garment usage to ensure the wearer is always protected.

BRIEF DESCRIPTION OF THE DRAWING FIGURES

DETAILED DESCRIPTION OF CERTAIN EMBODIMENTS

Figure 1:
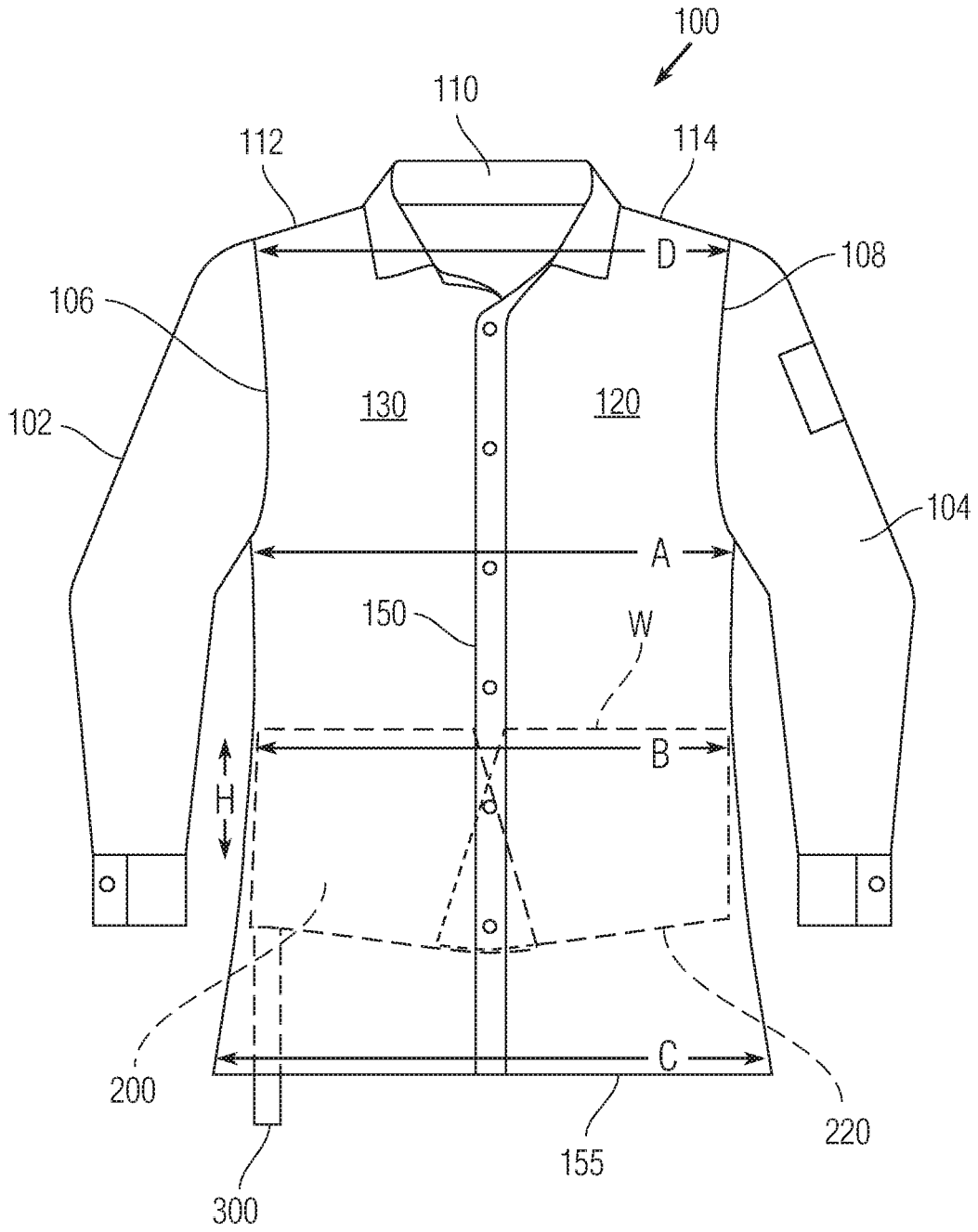
FIG. 1 is a front elevation view of a flame resistant garment in accordance with a first embodiment.
Figure 2:
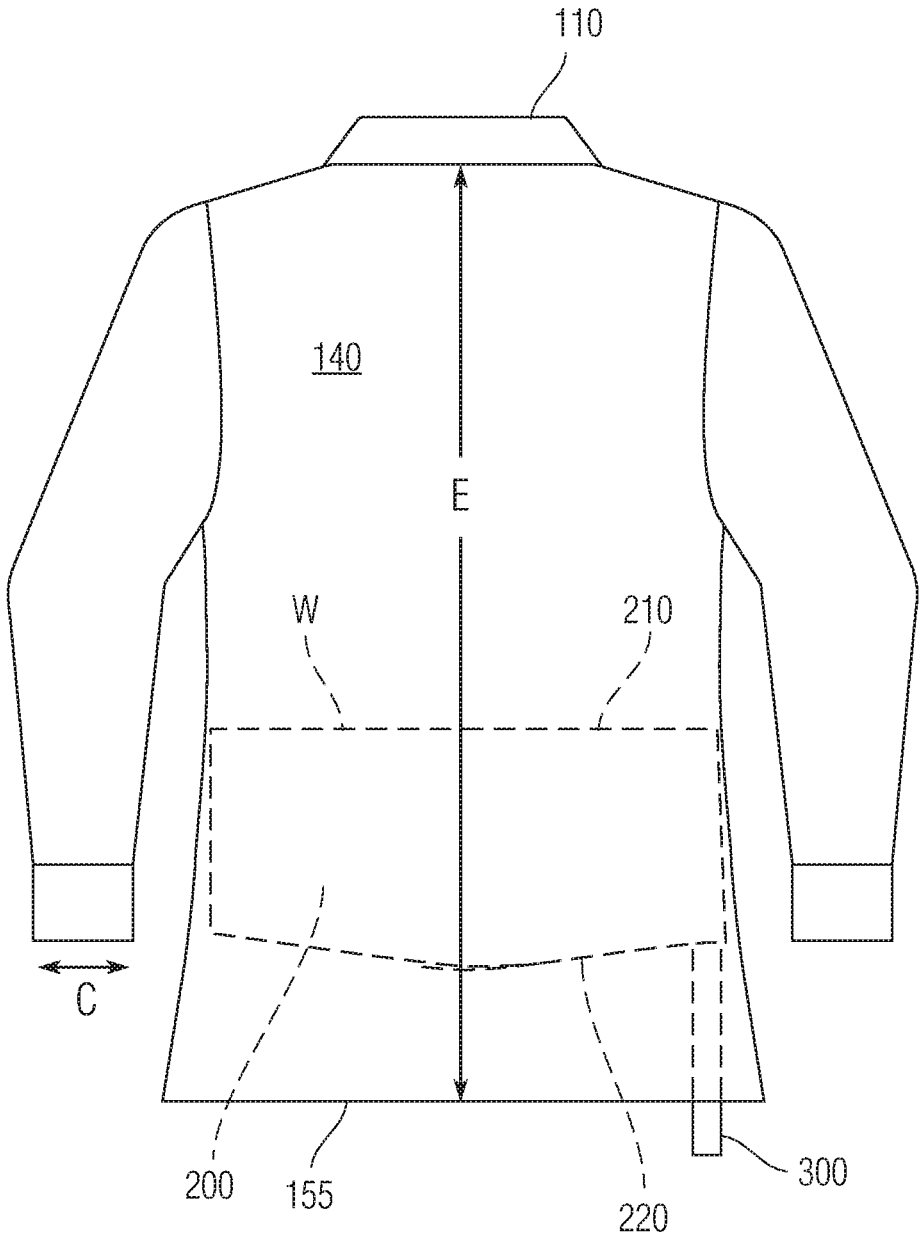
FIG. 2 is a rear elevation of the flame resistant garment.

FIGS. 1 and 2 illustrate a shirt (garment) 100 in accordance with one embodiment of the present invention. The shirt 100 can be considered to be a blouse and is particularly intended for wear by women. The shirt 100 can have a typical shirt construction and includes sleeves 102, 104 which extend from respective armholes 106, 108. A collar 110 is formed above a neck opening. Shoulder seams 112, 114 extend from armholes 106, 108 to the neck opening. The shirt 100 also includes a left front panel 120 and a right front panel 130 as well as a rear panel or back portion 140 (which together can be thought of as defining a main body portion). In order to detachably connect the left front panel 120 and the right front panel 130, a buttoned placket 150 is provided with buttons that are used to attach these two parts. As is known, in the buttoned placket 150 region, the two panels 120, 130 overlap.

The shirt 100 terminates in a bottom edge 155 that is defined by the bottom edge of each of the left front panel 120, the right front panel 130 and the back portion 140.

It will be understood that the aforementioned parts, namely, the collar 110, sleeves 102, 104, left front panel 120, the right front panel 130, and the rear portion 140 all define an outer layer (outer shell) of the shirt 100 and therefore when the term "outer layer" is used herein, it is generally referring to these main parts of the shirt 100.

In accordance with one embodiment, the collar 110, sleeves 102, 104, left front panel 120, the right front panel 130, and the rear portion 140 are constructed of a single ply of flame (fire) resistant fabric. However, it will be understood that it is contemplated that one or more of these parts of the outer layer of the shirt 100 could be formed of two plies of fire resistant fabric as opposed to a single ply.

In addition, the outer layer can be formed with a stiffened bottom hem for wearing outside of the bottom garment, such as pants/trousers. In addition, different front pocket options can be included in the shirt 100.

Fire Resistant Clothing

Flame resistant clothing is a special kind of personal protective equipment (PPE) designed to protect a person from fire-related hazards. Fire resistant clothing is not entirely "fire-proof." but rather is designed to reduce the wearer's risk of exposure to burn injuries while on the job. Fire resistant clothing generally works in the following manner. The clothing itself will catch fire if exposed to a flame. However, the clothing is designed to self-extinguish almost immediately. So, the clothing does not continue to burn once ignited. The two main types of clothing that fall under the umbrella of being fire resistant clothing are flame resistant clothing and flame retardant clothing.

Flame Resistant Clothing

Flame resistant clothing is made from material that is inherently resistant to flames and embers. Meaning that the threads and fibers will naturally self-extinguish. Flame retardant clothing on the other hand, is made from materials that have been chemically treated to achieve the same self-extinguishing properties.

For each category, there are many materials that are commercially available and are suitable for use in constructing clothing. For example, flame resistant clothing for various applications may be found made of materials which include, but are not limited to, Modacrylic, Nomex. Kevlar, wool, polybenzimidazole or PBI fibers, etc. It will be appreciated that other materials can be used so long as they are suitable for the intended application. In the illustrated embodiment, the shirt 100 is formed of Nomex fabric which is inherently flame resistant.

Inner Curtain (Inner Layer/Inner Liner)

Figure 3:
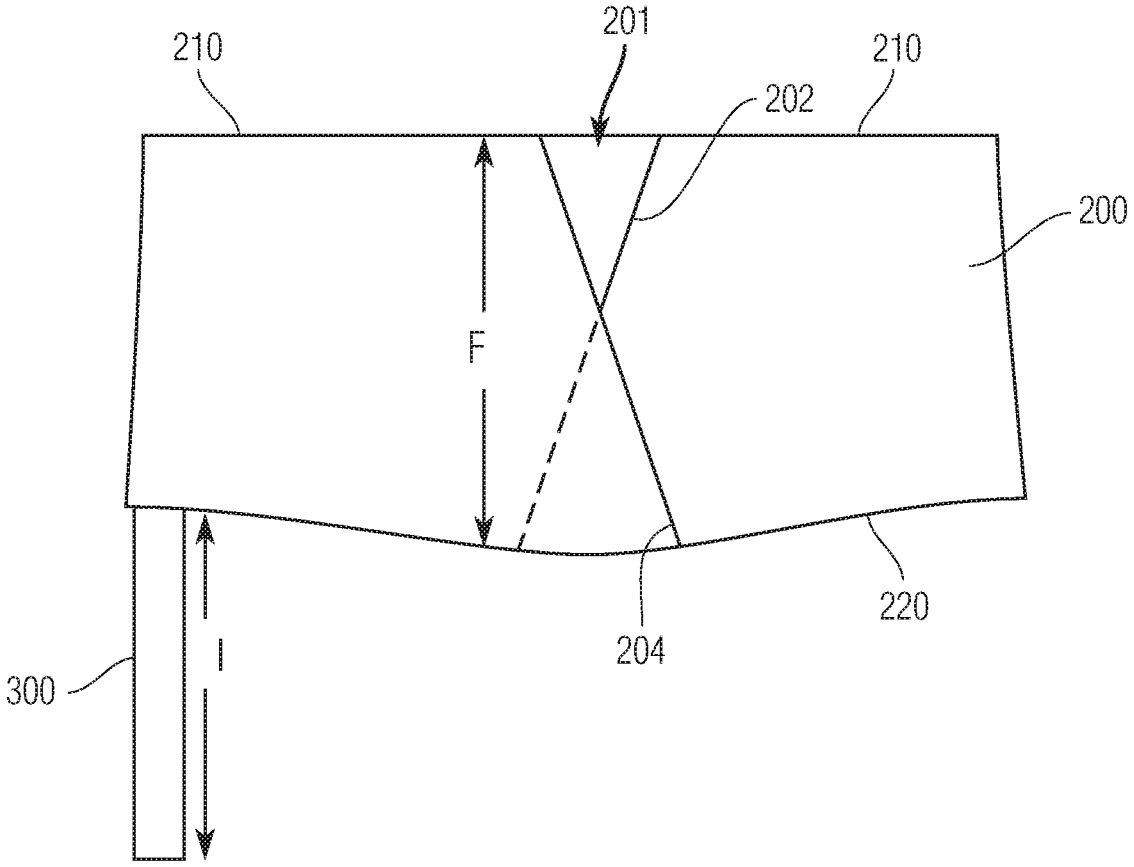
FIG. 3 is a front elevation view of an inner curtain and compliance indicator of the flame resistant garment.

In accordance with the present disclosure and with reference to FIGS. 1-3, the shirt 100 further includes an inner liner/layer in the form of an inner curtain 200 that is located internally within the outer layer of the shirt 100 when the shirt 100 is worn. As described herein, the inner curtain 200 is coupled to the inside of the outer layer such that within a select lower region of the shirt 100, there are two plies of material.

The inner curtain 200 can be in the form of a single piece of fabric that has a first end 202 and a second end 204 that are separated from one another to permit the inner curtain 200 to be wrapped and looped around the wearer's body when the first end 202 and the second end 204 are brought together. As shown, the first end 202 and the second end 204 are preferably angled ends (i.e., the ends are formed at angles other than 90 degrees relative to a top edge 210 and an opposing bottom edge 220 of the inner curtain 200). Each of the angled ends 202, 204 is constructed such that the end tapers outwardly in a direction toward the bottom edge 220 to provide enough material at the bottom edge to allow the overlapping of the angled ends 202, 204 at the bottom edge thereof during a normal wear condition.

The ends 202, 204 are designed at an angle to allow them to overlap, at least in center and/or lower regions thereof, in order to prevent a portion of the wearer's skin from not being covered/protected. Thus, the angled ends 202, 204 are placed in an overlapping orientation and are tucked into the bottom garment as described herein.

The bottom edge 220 can be a straight edge or it can have a contour, such as being a curved edge.

The inner curtain 200 is purposely positioned within the outer layer such that the top edge 210 is approximately located at or slightly above the waist of the wearer, while the bottom edge 220 lies below the waist. In the figures, the general waist region of the shirt is indicated with the dashed line labeled W. As is known in the shirt manufacturing field, the waist region of the shirt is generally where the shirt would be around the wearer's belly button or a little above it and a waist measurement is the narrowest part of your waist. In other words, the waist (region) is the part of the abdomen between the rib cage and hips and it is within this region that the top edge 210 lies.

As described herein, the inner curtain 200 is intended for insertion under (tucking in) a bottom garment, such as pants. As mentioned earlier, the bottom edge 220 does not extend below the bottom edge of the outer layer and therefore, the inner curtain 200 remains fully contained and hidden from view by the outer layer. The inner curtain 200 thus provides a discrete, hidden piece of fabric that can be tucked into the bottom garment without detracting from the look of the shirt 100.

The height of the inner curtain 200 is thus selected so that the inner curtain 200 can be properly positioned in this target region of the shirt 100 and more particularly, the inner curtain 200 provides a fabric layer that can be tucked into the bottom garment. Since the inner curtain 200 can be tucked into the bottom garment, the shirt 100 offers the highest level of protection in accordance with all relevant safety standards and regulations, while at the same time, the outer layer can be worn in an untucked manner thereby providing modesty since the bottom sections of the left front panel 120, the right front panel 130, and the rear portion 140 lie below the waist of the wearer.

The inner curtain 200 is coupled to the inside of the outer layer using traditional techniques. For example, the inner curtain 200 can be attached to the inside of the outer layer by sewing the top edge 210 to the inside of the outer layer at the waist region W. It will be appreciated that the angled nature of the ends 202, 204 allows the inner curtain 200 to be stitched to the inside of the outer layer at waist region W except where buttons are located within the buttoned placket 150 of the outer layer. The inner curtain 200 thus preferably does not extend into the buttoned placket 150 of the shirt 100. Thus, within the buttoned placket 150, only the overlapping portions of the outer layer are present and the inner curtain 200 is not present; however, the outward tapering of the ends 202, 204 toward the bottom edge 220 provides for ample material that can be overlapped. Thus, when worn, the inner curtain 200, at the bottom edge 220, defines a complete loop that can be tucked into the bottom garment. Conversely, at the top edge 210 there can be break 201 between the ends 202, 204 to accommodate the buttoned placket 150.

The length (height) of the inner curtain 200 can be different between the front section and the rear section. For example, the front section of the inner curtain 200 can be shorter relative to the rear section.

Figure 4:
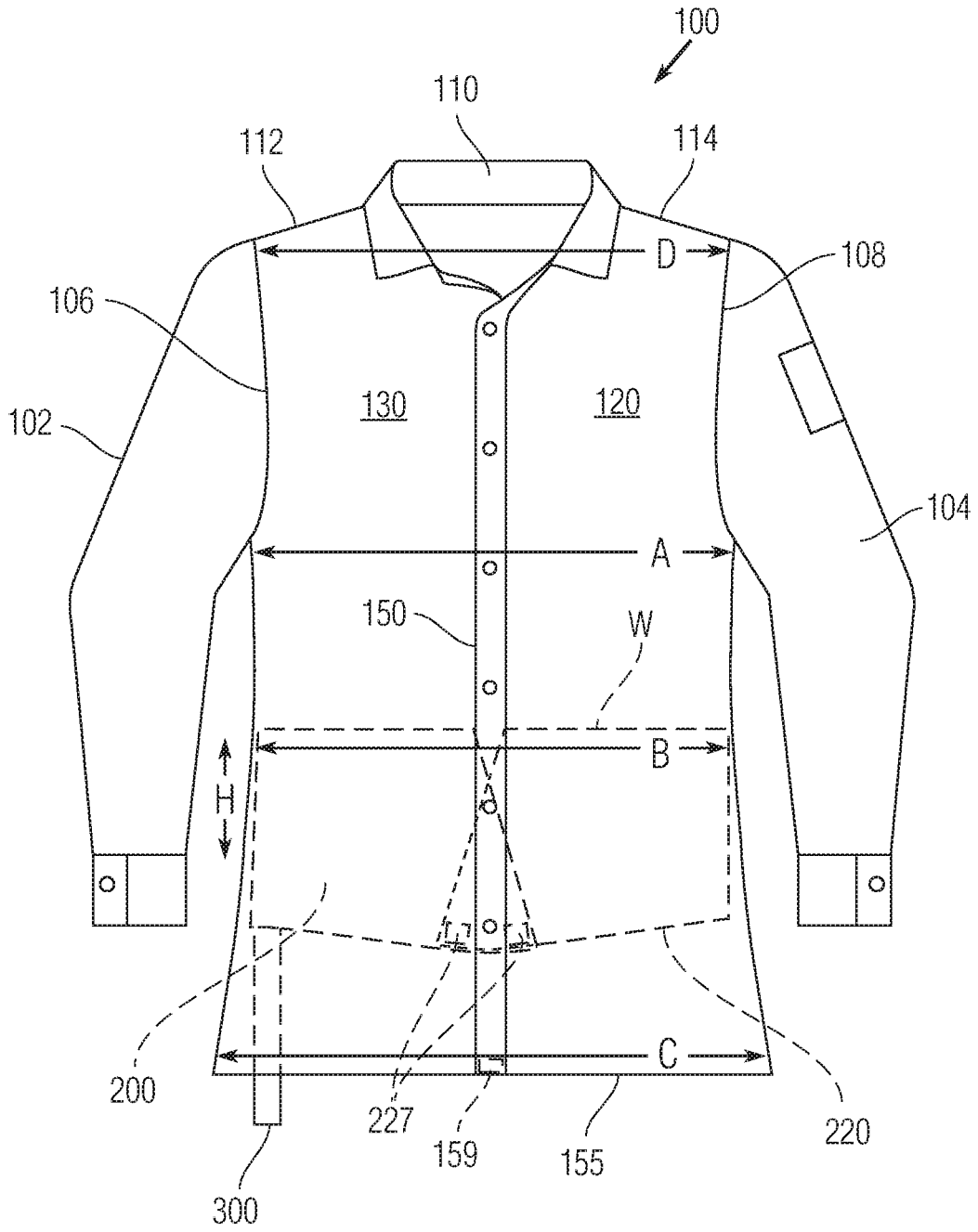
FIG. 4 is a front elevation view of a flame resistant garment in accordance with another embodiment.

The inner curtain 200 does not have a closure system. It is stitched to the inside of the outer layer at the waist area all the way around the outer layer but stopping before buttons of outer layer. The rest of the inner curtain 200 hangs loose to allow the wearer to easily tuck it inside the pants. Thus, the garment is worn as a traditional buttoned dress shirt, but tucking in the inner curtain 200 instead of the outer layer. In one embodiment shown in FIG. 4, there can be a fastener, such as a small piece of hook and loop material 159 at the bottom edge of the buttoned placket 150 to prevent the bottoms of the right front panel 130 and the left front panel 120 from being loose. FIG. 4 also illustrates an alternative embodiment in which the inner curtain 200 also optionally includes a fastener, such as hook and loop material 227, that can be used to attach the ends 202, 204 to one another in the region in which the two ends 202, 204 overlap.

In the shirt 100, according to one preferred embodiment, the inner curtain 200 is permanently attached to the inside of the outer layer, as by stitching or adhesive bonding (adhesive strip), or other permanent attachment techniques, it will be appreciated that one alternative that is less desirable but still possible is to use fasteners, such as use of snaps, buttons, a zipper, hook and loop material to attach the inner curtain 200 inside the outer layer.

Since the inner curtain 200 is tucked in the bottom garment, the applicable safety standards and regulations are complied with and therefore, the outer layer can be left untucked providing the desired modesty.

The shirt 100 thus has a two ply (double-layer) construction in the waist region of the shirt 100 in which both the outer layer and the inner curtain 200 are present. The surrounding regions of the shirt 100 have a single ply construction.

Fabric Weight

As is known, fabric weight is the outcome of how a fabric has been woven, its finish and sometimes the fiber type. GSM is a metric measurement meaning grams per square meter—it is how much 1 square meter of fabric weighs and the higher the GSM number the denser the fabric will be. Ounce per square yard (oz/yd$^2$) is the imperial measurement which is also commonly used. A lightweight fabric is typically between 30-150 GSM, medium weight 150-350 GSM and heavyweight 350+ GSM, such as our clear window PVC (640 GSM), although this can vary depending on the type of fabric.

In accordance with one embodiment, both the outer layer and the inner curtain 200 are formed of a preferably relatively light fabric (e.g., around 4.5 oz/yd2).

Compliance Indicator

FIGS. 1 and 2 illustrate yet another feature of the present invention.

One problem often times encountered in the use of such protective garments having two layers is that the two layers may not be properly worn. This lapse may be intentional or accidental. Since the outer layer obscures the visual observation of the inner liner (inner curtain 200), it is difficult for a supervisor to easily determine if all the workers are properly attired. In the event that both the inner and the outer layers are worn in an untucked manner, the wearer is at risk since flames and heat can rise up from under the garment, thereby directly exposing the wearer's skin to increased risk of burn injuries.

The inner curtain 200 includes a visible portion or compliance indicator in the form of at least one tag (tab) 300 that extends downwardly from the bottom edge 220 of the inner curtain 200. The tag 300 is preferably oriented 90 degrees relative to the bottom edge 220. The tag 300 can be formed of any number of suitable materials including but not limited to the same material as the inner curtain 200 and the outer layer (e.g., Nomex) or it can be formed of a different material. For example, the tag 300 can be formed of a fabric or can be formed of a polymeric material or other suitable material. The tag 300 is formed of a flame resistant material.

One or more faces of the tag 300 can have identifying indicia such as graphics and/or text. For example, one or more faces of the tag 30) can have the words "KEEP TUCKED IN" written on it in order to remind the wearer to keep the inner curtain 200 tucked in for the wearer's protection. In addition, the tag 300 can be formed of a bright color, such as red, yellow or orange in order to make it easy to observe when it extends below the bottom edge 155 of the outer layer.

The tag 300 has a length such that when the bottom section of the inner curtain 200 is not tucked in, at least a bottom end section of the tag 300 is visible below the bottom edge 155 of the outer layer of the shirt 100. The tag 300 is formed such that the bottom end section extends sufficiently below the bottom edge 155 of the outer layer so as to make it very easy to see the tag 300. More particularly, if the wearer chose not to tuck the inner curtain 200 in, the tag 300 would be easily visible for others (i.e., their supervisor), or the wearer herself, since the tag 300 would protrude below the bottom edge 155 of the outer layer. Conversely, when the inner curtain 200 is properly tucked in, the tag 300 will not be visible to the observer. Thus, the tag 300 is a feature that helps ensure compliance with proper garment usage to assure the wearer is always protected.

Unlike other two ply layer clothing, the inner curtain 200 starts only from the waist down in order to minimize the weight (heat) of the garment (shirt 100). The inner curtain 200 is thus specifically constructed to offer a light-weight solution that complies with applicable safety standards since the inner curtain 200 is designed to be tucked in, thereby allowing the outer layer to be untucked which allows for the desired modesty.

In addition, the shirt 100 can be constructed such that there is one tag 300 along the rear portion 140 and another tag 300 along one of the left front portion 120 and the right front portion 130. With this type of construction, the tag 300 can be visually seen and identified from viewing the front and/or back of the worker (wearer).

Example

FIGS. 1-3 illustrate one exemplary shirt 100 and include lettered dimension lines that describe the construction of the shirt 100. The following Table sets forth exemplary values for these dimensions and also it will be understood that the shirt 100 comes in many different sizes, such as the traditional US sizes (women's sizes) listed in the table.

As set forth in the below Table, the arrow A indicates the chest dimension, the arrow B indicates the waist dimension (a waist line), the arrow C indicates the hem straight (bottom hem) dimension at the bottom edge; the arrow D indicates the shoulder dimension; the arrow E indicates the complete length; the arrow F indicates the front length of the inner curtain 200, the arrow G indicates the back length of the inner curtain 200, the arrow H indicates the side opening length; and the arrow I indicates the length of the tag 300.

Figure 5:
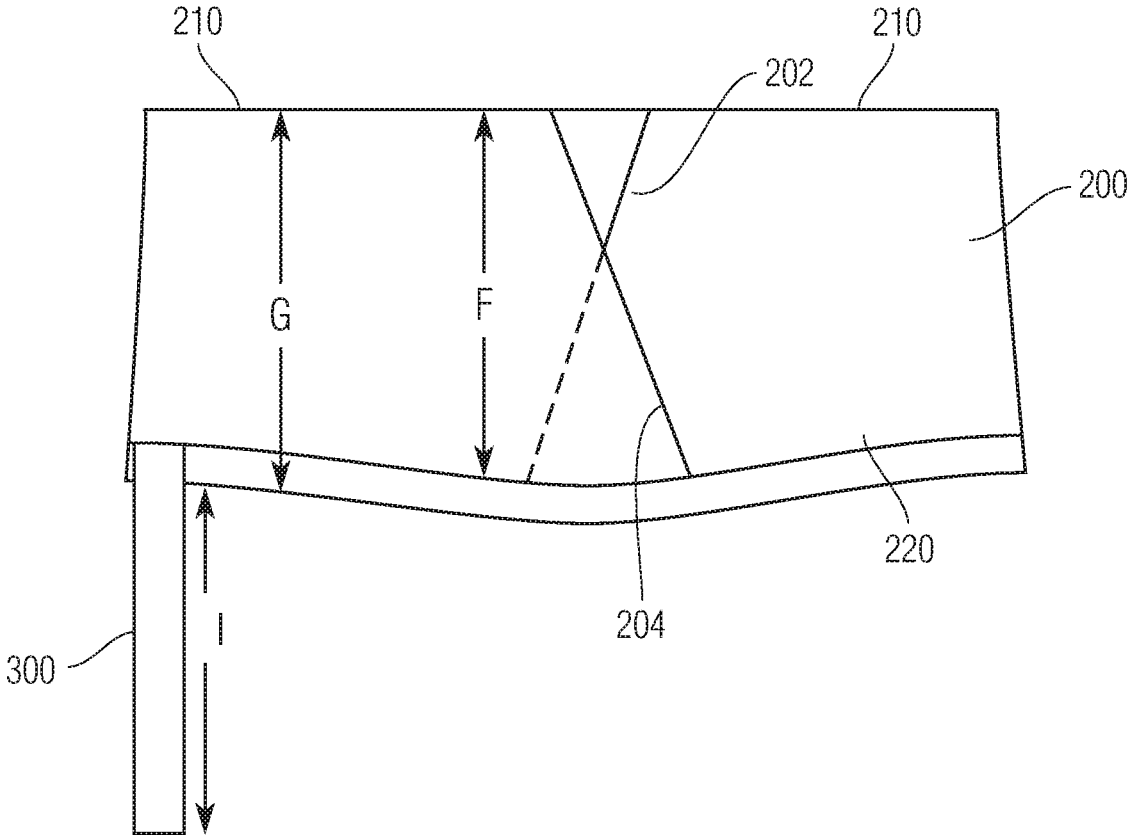
FIG. 5 is a front elevation view of an inner curtain in accordance with another embodiment.

The side opening, identified by arrow H, can be side slits that are formed in the outer layer of the shirt to facilitate access to the pant pockets. As set forth in the below Table, in one embodiment that is shown in FIG. 5, the front and back of the inner curtain 200 can have different lengths. In particular, the back (rear) of the inner curtain 200 can be longer than the front of the inner curtain 200 (i.e., length G>length F). This is shown in FIG. 5.

| | | US Size | | | | | | |
|---|---|---|---|---|---|---|---|---|
| | Description | 2 | 4 | 6 | 8 | 10 | 12 | 14 |
| A | CHEST - AT UNDERARM | 18 | 19 | 20 | 21 | 22 | 23 | 24 |
| B | WAIST | 17 | 18 | 19 | 21 | 20 | 22 | 23 |
| C | HEMLENGTH AT BOTTOM EDGE | 21¾ | 22¾ | 23¾ | 24¾ | 25¾ | 26¾ | 27¾ |
| D | SHOULDER | 15¼ | 15¾ | 16¼ | 16¾ | 17¼ | 17¾ | 18¼ |
| E | COMPLETE LENGTH | 30¼ | 30½ | 30¾ | 31 | 31¼ | 31½ | 31¾ |
| F | FRONT LENGTH - INNER LAYER | 8⅝ | 8⅝ | 8⅝ | 8⅝ | 8⅝ | 8⅝ | 8⅝ |
| G | BACK LENGTH - INNER LAYER | 10¼ | 10¼ | 10¼ | 10¼ | 10¼ | 10¼ | 10¼ |
| H | SIDE OPEN LENGTH | 6.00 | 6.00 | 6.00 | 6.00 | 6.00 | 6.00 | 6.00 |
| I | TAG LENGTH | 7½ | 7½ | 7½ | 7½ | 7½ | 7½ | 7½ |

| | | US Size | | | | | | TOL |
|---|---|---|---|---|---|---|---|---|
| | Description | 16 | 18 | 20 | 22 | 24 | 26 | (+/−) |
| A | CHEST - AT UNDERARM | 25 | 26 | 27 | 28 | 29 | 30 | 1 −½ |
| B | WAIST | 24 | 25 | 26 | 27 | 28 | 29 | 1 −½ |
| C | HEMLENGTH AT BOTTOM EDGE | 28¾ | 29¾ | 30¾ | 31¾ | 32¾ | 33¾ | 1 −½ |
| D | SHOULDER | 18¾ | 19¼ | 19¾ | 20¼ | 20¾ | 21¼ | 1 −½ |
| E | COMPLETE LENGTH | 32 | 32¼ | 32½ | 32¾ | 33 | 33¼ | 1 −½ |
| F | FRONT LENGTH - INNER LAYER | 8⅝ | 8⅝ | 8⅝ | 8⅝ | 8⅝ | 8⅝ | ½ −½ |
| G | BACK LENGTH - INNER LAYER | 10¼ | 10¼ | 10¼ | 10¼ | 10¼ | 10 ¼ | ½ −½ |
| H | SIDE OPEN LENGTH | 6.00 | 6.00 | 6.00 | 6.00 | 6.00 | 6.00 | ½ −½ |
| I | TAG LENGTH | 7½ | 7½ | 7½ | 7½ | 7½ | 7½ | ½ −½ |

(All dimensions are listed in inches)

It will be understood that the values in the above table are merely exemplary in nature and do not limit the scope of the present invention.

Applicable Safety Standards

The shirt 100 has been tested using internationally accepted safety standards and it has been found to be compliant with NFPA 2112 meaning that the wearer will sustain less than 50% body burn injury if subjected to flash fire exposure. The Saudi Arabian Government's High Commission on Industrial Security (HCIS) requires compliance with this international standard.

Advantages of the Disclosed Shirt Construction

The shirt 100 provides an article of flame resistant clothing for women of the Middle Eastern region (e.g., Muslim/Islamic women). By wearing the innovative shirt 100, women will not need an extra layer (e.g., an outer jacket) to avoid accentuating their form and will not need to wear the standard flame resistant shirts untucked, exposing themselves to burn injuries. Even though the design contains two layers, the second layer (i.e., the inner curtain 200) is only present from the waist down and both layers are preferably relatively light (4.5 oz/yd$^2$). Thus, heat stress is not a concern.

The shirt allows the wearer to meet both safety requirements and cultural norms. Through the present design, the wearer is able to avoid accentuating their form without the need of an extra garment. Moreover, the wearer will be protected from potential intermittent flames or thermal exposure through the tucked-in inner layer (inner curtain 200). The present garment has the ability to protect the life of the wearer in the event of a flash fire scenario. Commercially available alternatives currently do not accommodate individual's conservative and modest choices. Consequently, unaware of the additional risk it represents, women have been wearing regular flame resistant shirts untucked to avoid accentuating their form. Doing so puts them at risk as heat and flames can travel up under the untucked garment and come in direct contact with their skin in the event of a flash fire. This double-layered shirt allows the user to obtain the conservative look of a long untucked shirt without being exposed to potential burn injuries (as the tucked-in inner curtain serves as a barrier between the flames and the wearer's skin).

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A flame resistant shirt comprising:

an outer layer that has a main body portion and a pair of sleeves, the main body portion terminating in a bottom edge; and an inner curtain that is coupled to an inner surface of the main body portion and has a top edge and an opposing bottom edge, wherein the top edge of the inner curtain is located at a waist region of the main body portion and the inner curtain extends downwardly therefrom and the bottom edge of the inner curtain is disposed above the bottom edge of the main body portion;

wherein each of the outer layer and the inner curtain is formed of a flame resistant material;

wherein the inner curtain comprises a piece of fabric having a first end and an opposing second end, the inner curtain being attached to the main body portion only along the top edge of the inner curtain such that the bottom edge of the inner curtain including at the first end and the second end are loose and detached from the main body portion, wherein upper edges of the first end and the second end are attached to the main body portion such that the upper edges of the first end and the second end are spaced apart and do not overlap, while lower edges of the first end and the second end overlap one another along a front portion of the outer layer.

2. The flame resistant shirt of claim 1, wherein the top edge is stitched to an inside of the main body portion.

3. The flame resistant shirt of claim 1, wherein each of the first end and the second end comprises an angled end.

4. The flame resistant shirt of claim 3, wherein each angled end of the first end and the second end tapers outwardly in a direction toward the bottom edge.

5. The flame resistant shirt of claim 4, wherein the main body portion includes a buttoned placket along which a left front panel is attached to a right front panel, the first end and the second end of the inner curtain being attached to the main body portion at locations outside of the buttoned placket.

6. The flame resistant shirt of claim 1, wherein the top edge of the inner curtain is attached to the inner surface of the main body portion by an adhesive bond.

7. The flame resistant shirt of claim 1, wherein a height of the inner curtain is between 40% to 60% of a distance between a waist line within the waist region and the bottom edge of the outer layer.

8. A flame resistant shirt comprising:

an outer layer that has a main body portion and a pair of sleeves, the main body portion terminating in a bottom edge;

an inner curtain that is coupled to an inner surface of the main body portion and has a top edge and an opposing bottom edge, wherein the top edge of the inner curtain is located at a waist region of the main body portion and the inner curtain extends downwardly therefrom and the bottom edge of the inner curtain is disposed above the bottom edge of the main body portion; wherein each of the outer layer and the inner curtain is formed of a flame resistant material;

wherein the inner curtain comprises a piece of fabric having a top edge, an opposite bottom edge, a first end and an opposing second end, the inner curtain being attached to the main body portion only along the top edge of the inner curtain;

wherein each of the first end and the second end comprises an angled end;

wherein each angled end of the first end and the second end tapers outwardly in a direction toward the bottom edge;

wherein the first end and the second end overlap one another.

9. The flame resistant shirt of claim 8, wherein the first end and the second overlap one another in bottom sections thereof.

10. A flame resistant shirt comprising:

an outer layer that has a main body portion that terminates in a bottom edge; and an inner curtain that is coupled to an inner surface of the main body portion and has a top edge and an opposing bottom edge, wherein the top edge of the inner curtain is located at a waist region of the main body portion and the inner curtain extends downwardly therefrom and the bottom edge of the inner curtain is disposed above the bottom edge of the main body portion;

wherein each of the outer layer and the inner curtain is formed of a flame resistant material;

wherein the inner curtain comprises a piece of fabric having a top edge, an opposite bottom edge, a first end and an opposing second end, the inner curtain being attached to the main body portion only along the top edge of the inner curtain, each of the first end and the second end being an angled end such that the first end and the second end are not in contact with one another at the top edge of the inner curtain, while the first end and the second end overlap one another at the bottom edge of the inner curtain to allow for being tucked into a bottom garment.

11. A flame resistant shirt comprising:

an outer layer that has a main body portion that terminates in a bottom edge; and an inner curtain that is coupled to an inner surface of the main body portion and has a top edge and an opposing bottom edge, wherein the top edge of the inner curtain is located at a waist region of the main body portion and the inner curtain extends downwardly therefrom and the bottom edge of the inner curtain is disposed above the bottom edge of the main body portion; and a compliance indicator that comprises a hang tag that is coupled to the inner curtain and hangs downwardly therefrom and has a length such that a bottom end of the compliance indicator is visible below the bottom edge of the outer layer;

wherein the inner curtain comprises a piece of fabric having a top edge, and an opposite bottom edge, the inner curtain being attached to the main body portion along the top edge of the inner curtain, while the bottom edge is free of attachment to the main body portion;

wherein each of the outer layer, the inner curtain, and the hang tag is formed of a flame resistant material.

12. The flame resistant shirt of claim 11, wherein each of the outer layer, the inner curtain and the hang tag is formed of the same material and the hang tag has a color selected from the group consisting of yellow, red and orange to visually differentiate it from a color of the outer layer.

13. The flame resistant shirt of claim 11, wherein the hang tag has a color selected from the group consisting of orange, red and yellow and includes identifying indicia.

14. The flame resistant shirt of claim 13, wherein the identifying indicia comprises text.

15. The flame resistant shirt of claim 11, wherein the hang tag is formed of a fire resistant material.

16. The flame resistant shirt of claim 11, wherein a length of the hang tag is between 60% and 90% of a length of the inner curtain.

17. The flame resistant shirt of claim 16, wherein at least 10% of the length of the hang tag is exposed below the bottom edge of the main body portion.

* * * * *